US007441438B2

(12) United States Patent
Bissonnette et al.

(10) Patent No.: US 7,441,438 B2
(45) Date of Patent: Oct. 28, 2008

(54) APPARATUS FOR CALIBRATING GOLF BALL LAUNCH MONITORS

(75) Inventors: Laurent Bissonnette, Portsmouth, RI (US); Michael J. Toupin, Fall River, MA (US)

(73) Assignee: Acushnet Company, Fairhaven, MA (US)

( * ) Notice: Subject to any disclaimer, the term of this patent is extended or adjusted under 35 U.S.C. 154(b) by 412 days.

(21) Appl. No.: 11/297,568

(22) Filed: Dec. 8, 2005

(65) Prior Publication Data

US 2007/0135223 A1 Jun. 14, 2007

(51) Int. Cl.
*G01P 21/00* (2006.01)

(52) U.S. Cl. ..... 73/1.37; 73/1.01

(58) Field of Classification Search ..... 73/1.01, 73/1.37; 473/197–199
See application file for complete search history.

(56) References Cited

U.S. PATENT DOCUMENTS 4,136,387 A * 1/1979 Sullivan et al. ..... 473/200
5,803,823 A 9/1998 Gobush et al.
6,500,073 B1 12/2002 Gobush et al.
6,533,674 B1 3/2003 Gobush
6,616,543 B1 9/2003 Gobush et al.
6,764,412 B2 7/2004 Gobush et al.
6,781,621 B1 8/2004 Gobush et al.
2002/0155896 A1 10/2002 Gobush et al.
2003/0130054 A1 7/2003 Bissonette et al.
2004/0248662 A1 12/2004 Gobush et al.

* cited by examiner

*Primary Examiner*—Hezron Williams
*Assistant Examiner*—Nashmiya S Fayyaz
(74) *Attorney, Agent, or Firm*—D. Michael Burns

(57) ABSTRACT

The present invention is directed to a calibration apparatus and method for calibrating and verifying the accuracy of a golf ball launch monitor. The apparatus includes a support structure and a rotatable wheel that has embedded golf balls evenly dispersed at a known distance from the center of the wheel, and a field of view opening in a protective cover. A power device, typically an electric motor, rotates the wheel at a predetermined speed to establish a known speed and spin rate of the golf balls. Each golf ball surface includes contrasting markings. Camera(s) of the launch monitor are focused on the field-of-view wherein each camera is triggered such that two images of a ball are captured. The monitor has a computer to analyze data for speed and spin rate of the golf balls. A comparison of this data to the established known speed and spin rate of the calibration apparatus enables determination of the accuracy and repeatability of the monitor.

8 Claims, 4 Drawing Sheets

APPARATUS FOR CALIBRATING GOLF BALL LAUNCH MONITORS

FIELD OF THE INVENTION

The present invention relates to sports objects, and more particularly relates to an apparatus for verifying the accuracy of golf ball launch monitors. Particularly, launch monitors of a type that incorporate photographic images of a golf ball to compute performance data.

BACKGROUND OF THE INVENTION

Launch monitors for measuring golf ball flight characteristics and club head swing characteristics are known. Typically, the golf ball is marked with at least one contrasting area and the launch monitor acquires photographic images of the ball to compute performance characteristics.

One particularly problem has been the ability to verify that the information received from the launch monitors is accurate and repeatable. Improvements to launch monitors wherein they are now easily portable, which is of particular importance in that monitors need to be moved to the most desirable teaching or club fitting locations, e.g., on an outdoor driving range or golf course fairway. Because of the repeated handling and movement of these portable monitors, it is crucial that the accuracy be maintained and a reliable method available to substantiate that the performance data that is presented to the golfer is correct. Therefore, there must be an easy and convenient means to calibrate launch monitors to insure their accuracy. Present methods for checking accuracy of launch monitors have been limited to those of a static nature, and there has been a need in the industry for an apparatus that employs a dynamic verification method. The present invention presents such an apparatus.

SUMMARY OF THE INVENTION

Broadly, the present invention comprises an apparatus and method for dynamically calibrating launch monitor systems. Specifically, those launch monitors that employ at least one camera to capture images which are then analyzed by a computer either incorporated into the launch monitor structure or connected to it, which transposes the images into performance data, typically data such as ball speed, launch angle and spin rate.

The calibration apparatus of the present invention includes a support structure, a motorized wheel disposed on the support structure and a cover for the wheel. The wheel having four evenly spaced golf balls held in place by a specially designed retaining system. The distance from the center of the wheel to the centers of the golf balls is fixed and when the wheel is spun at a known measured revolution rate, then the speed, velocity and spin rates of the golf balls are established as fixed constants. The four golf balls have specific contrasting areas or markings on them, which can be seen by an imaging system produced and captured by the cameras of the launch monitor. The camera(s) is focused upon a field-of-view (FOV) that is provided by an opening in the cover of the wheel wherein the golf balls are seen as they spin through the opening. Once the computer of the launch monitor analyzes the photo images and translates them into ball speed, velocity, and spin rate, this data is compared to known fixed constants and any deviations by the monitor are corrected. Golfers evaluated by the launch monitor depend upon the information generated therein to be correct, as this information is often relied upon when a golfer purchases golfing equipment. It is therefore critical to the process that the information provided by the launch monitors not only be accurate but be repeatable, and because of the high portability and movement of these monitors, their verification must be made on a regular basis. The calibration apparatus of the present invention is easy to use, and will verify that the information obtained by the launch monitor is accurate. This calibration apparatus of the present invention is designed to be used with any launch monitor system that employs at least one camera to capture images that are then translated by a computer into performance data including ball speed, launch angle, and spin rate.

When in use, the calibrating apparatus is positioned at a known distance from the launch monitor, and the camera units of the monitor are focused on the field of view. The four golf balls, which are evenly displaced from the center of a circular wheel, each have six contrasting markings or dots, and are for example, reflective markings, retro-reflective dots, painted markings, or printed logos. The launch monitor typically includes a computer employing at least one algorithm, and at least one camera. Each camera is focused on the field of view which is an opening in the cover surrounding the wheel. Upon a stimulus triggering the camera(s), each camera takes at least two images of the golf ball. The computer of the launch monitor calculates the golf ball speed, velocity and spin rate from the acquired ball images. Since the wheel is rotated at a known RPM revolution rate, the speed and velocity of the golf balls on the wheel are easily determined. A simple inexpensive revolution rate meter may be used to determine wheel revolution rate. Since the ball is rigidly secured to the wheel, the rotation rate of the balls is identical to the rotation rate of the wheel. The speed of the ball is the product of the revolution rate (measured in radians per second) of the wheel multiplied by the radial distance between the center of rotation of the wheel and the center of the ball. The speed and velocity data calculated by the launch monitors is correlated against the known speed and velocity of the calibration apparatus to verify the accuracy of the monitor.

DESCRIPTION OF THE PREFERRED EMBODIMENT

Figure 1:
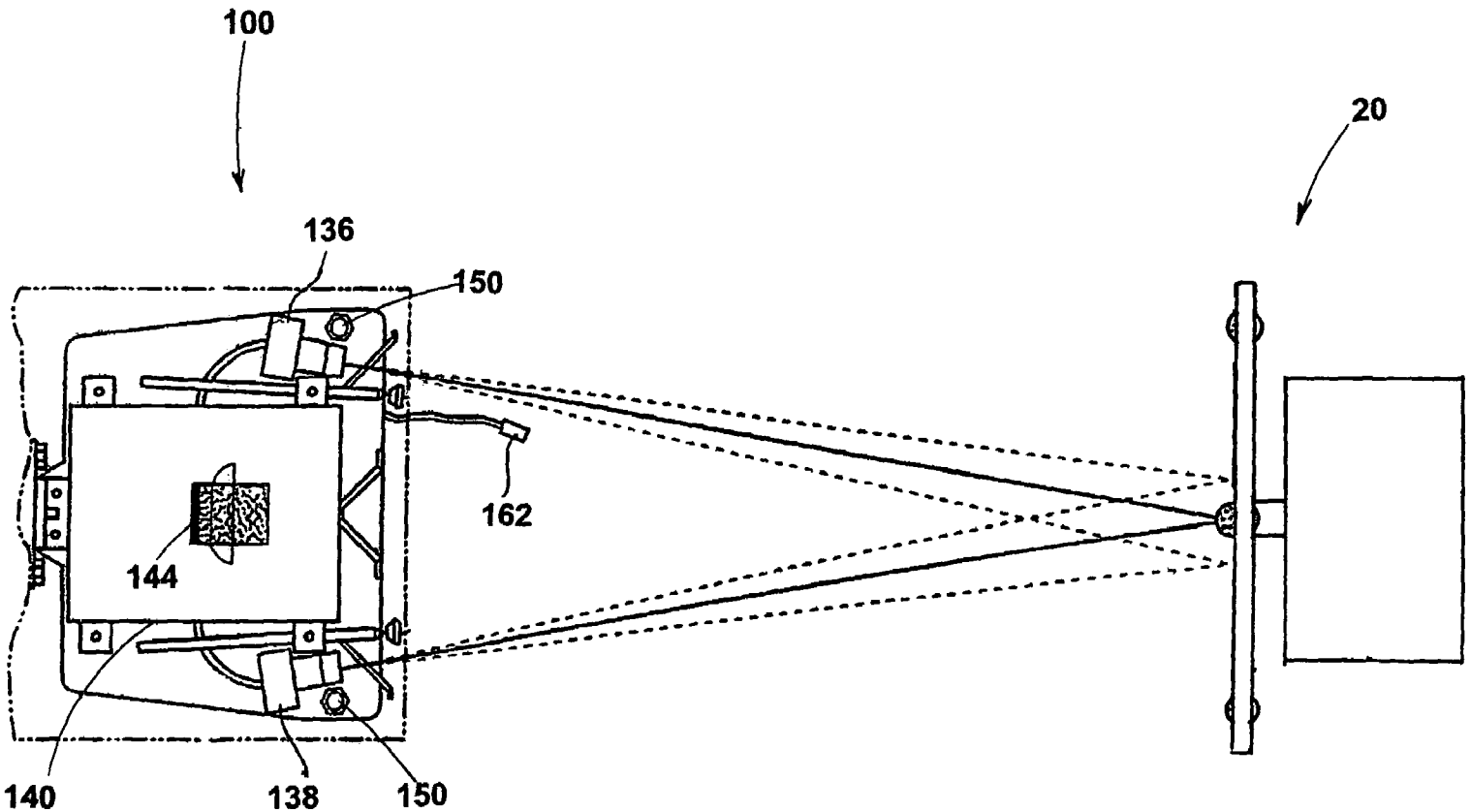
FIG. 1 is a perspective view of a typical launch monitor and an apparatus of the present invention in position for calibrating the monitor.

FIG. 1 illustrates an embodiment of the invention in which a calibration apparatus 20 is used to calibrate the accuracy of portable launch monitors, such as that shown by the reference 100. The calibration apparatus 20 of the present invention is described below and is designed to calibrate launch monitors that utilize camera units to capture ball images which are then processed by a computer. The computer translates the ball images into performance data such as speed, velocity and spin rate.

A typical launch monitor 100 of the type discussed above is disclosed in FIG. 1, and is described in U.S. Pat. No. 6,616, 543 which is incorporated herein in its entirety by express reference thereto. The process in which the launch monitor translates the photo images into performance data is described therein. These monitor types generally employ first and second camera units 136 and 138, a control box 140, a strobe light unit comprised of a single flash bulb assembly 144, the related circuitry, and a flash tube. Created between the two cameras' line of sight is an angle of about 10° to about 30° with about 22° being most preferable. Each of the cameras 136, 138 has a light-receiving aperture, shutter, and light sensitive silicon panel which corresponds to an image captured by the cameras. The cameras 136, 138 are directed and focused on the predetermined field-of-view (FOV) wherein a golf ball rotates through the FOV and is imaged as discussed below. The control box 140 communicates via an asynchronous protocol via a computer's parallel port to the camera units 136, 138 to control their activation and the strobe flash bulb assembly 144 is capable of flashing faster than every 1000 microseconds. The strobe light sequentially directs light onto a beam splitter through windows to reflective panels in the predetermined field-of-view. The panels may be plates formed of polished metal, such as stainless steel or chrome-plated metal. Each reflective panel includes an aperture, wherein the respective lenses of each camera is directed to the predetermined field-of-view through the apertures. The locations of the strobe light, beam splitter, reflective elements and cameras allow the light directed from the strobe to enter the field-of-view and be reflected back from the ball, due to dots (that may have a reflective surface), and subsequently to the camera lenses through the apertures. Some launch monitors have telescoping distance calibrators to control the distance of the system to the object, however a manual measurement is just as effective. While the actual mechanism of various launch monitors may be different, the basic operational principles are fairly similar. An example of a commercially available launch monitor which utilizes ball images to calculate performance data is the Vector, available from AccuSport, located in North Carolina. The value of any launch monitor is dependent upon the accuracy and repeatability of the results it produces. It is therefore of utmost importance that a launch monitor be calibrated periodically to verify that the data it is producing is accurate. Static calibration devices for use in calibrating launch monitors are known and described in U.S. Pat. No. 6,781,621 which is incorporated herein in its entirety by express reference thereto.

Figure 2:
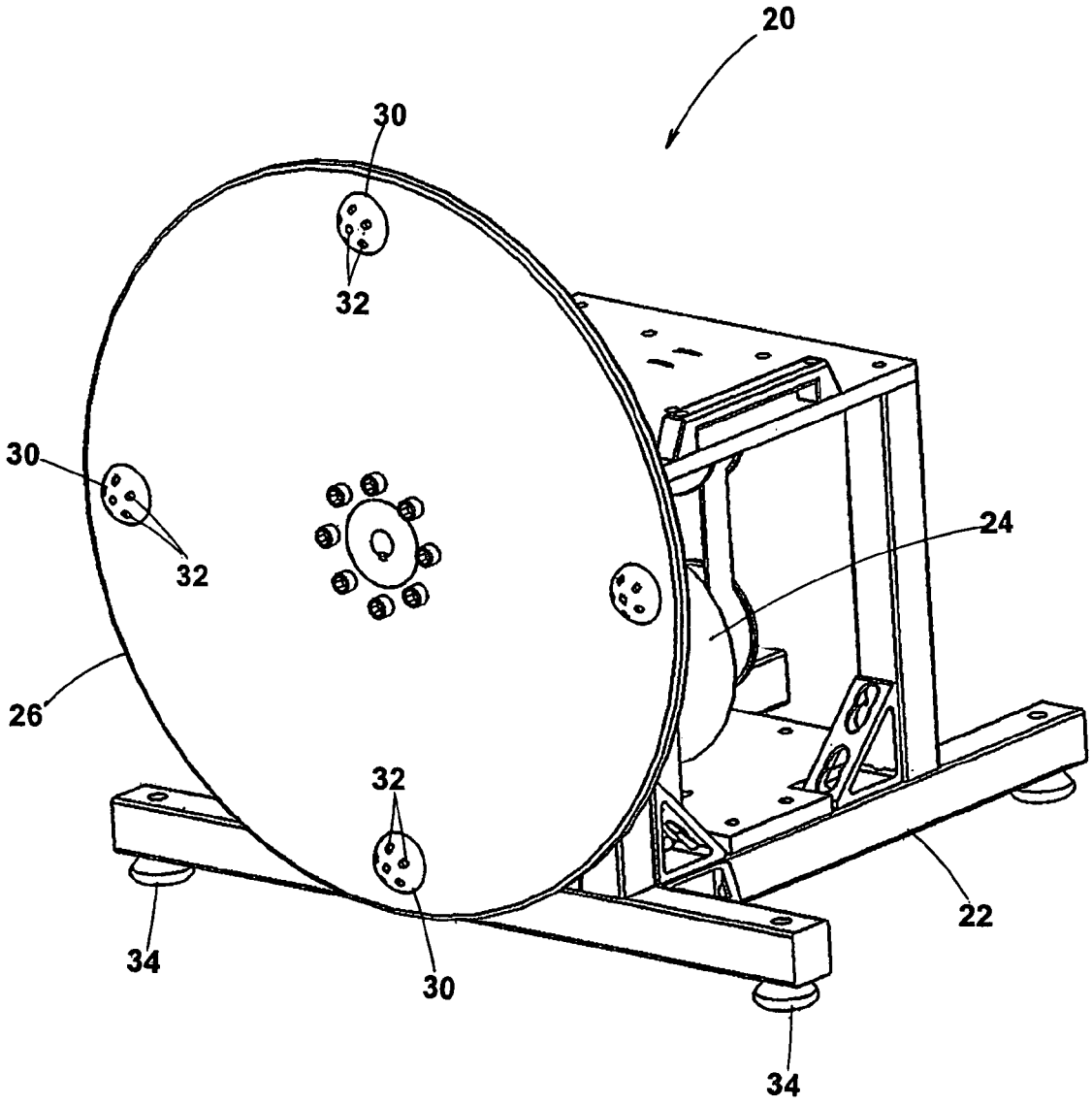
FIG. 2 is a perspective view of the apparatus of the present invention displaying four equally spaced golf balls on a rotatable wheel, each ball having specific markings thereon.
Figure 3:
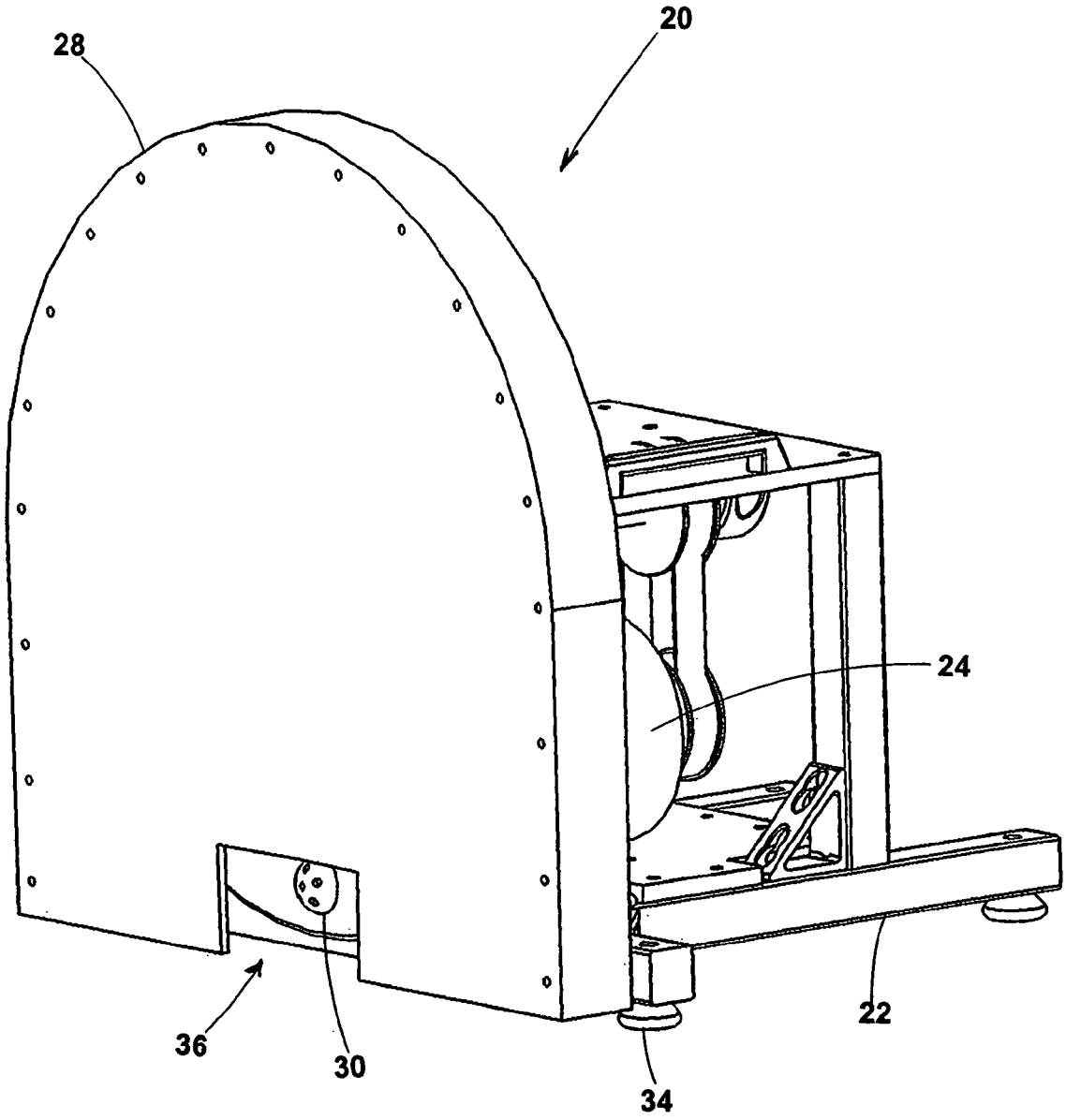
FIG. 3 is a perspective view of FIG. 2 with a hooded shroud covering the wheel showing an opening representing the field-of-view for the launch monitor.

The present invention utilizes a dynamic calibration apparatus as described in FIGS. 1-3, and includes a base or support structure 22, a wheel 26 that is driven by a powering device, typically an electric motor 24, and a protective cover 28 (FIG. 3) over the wheel 26. As stated above, the calibration apparatus 20 is designed to verify launch monitoring systems of the type that employ cameras to capture ball images which are mathematically transposed by a computer system to produce performance data such as speed, launch angle, and spin rate. The apparatus 20 generally includes an optical level indicator (not shown) for allowing the apparatus 20 to be leveled before the calibration procedure. Feet 34 extend from the bottom of apparatus 20 and are adjustable for leveling purposes. The wheel 26 has four embedded golf balls 30 evenly displaced in a location from the center of the wheel 26. Each golf ball 30 has contrasting areas, dots or bars 32 imposed on the surface and for the present invention five (5) dots and one bar 32 are employed on each ball 30. The cover 28 has a field-of-view (FOV) opening 36 in which the cameras 136, 138 are focused to capture images of the rotating golf balls 30.

The calibration process begins with setting up and leveling the calibration apparatus 20. The system is preferably set up on level ground. The launch monitor 100 is positioned at a normal operating distance from the balls 30 which are mounted into the wheel 26 and are visible through the field-of-view opening 36 in the protective cover 28. Adjusting screws 150 may be used to level the calibration apparatus. It is preferred that both the calibration apparatus 20 and the launch monitor 100 be leveled.

Once the wheel 26 of the calibrating apparatus 20 is spinning at a constant predetermined revolution rate the launch monitor system 100 is triggered by an electric proximity sensor unit (not shown) being activated causing a first image to be recorded by both cameras 136, 138. There is an intervening, predetermined time delay, between proximity detection and triggering the launch monitor 100 to ensure that the ball 30 is within the field of view. Four alternative delay settings are available to allow any one of the four balls 30 to be present in the field of view 36 when the launch monitor 100 acquires images.

The camera system 136, 138 upon being triggered take a picture of the spinning golf balls 30 and the resulting images are sent to a buffer. The launch monitor determines the location of the centers of the markings in each image corresponding to the markings 32 on the golf balls 30 being spun at a known revolution rate by the calibration apparatus wheel 26. Once the location of each of the markings on a golf ball is determined, the launch monitor system 20 with knowledge of the true spacing of the golf balls 30 and the markings 32 calculates performance data.

Figure 4:
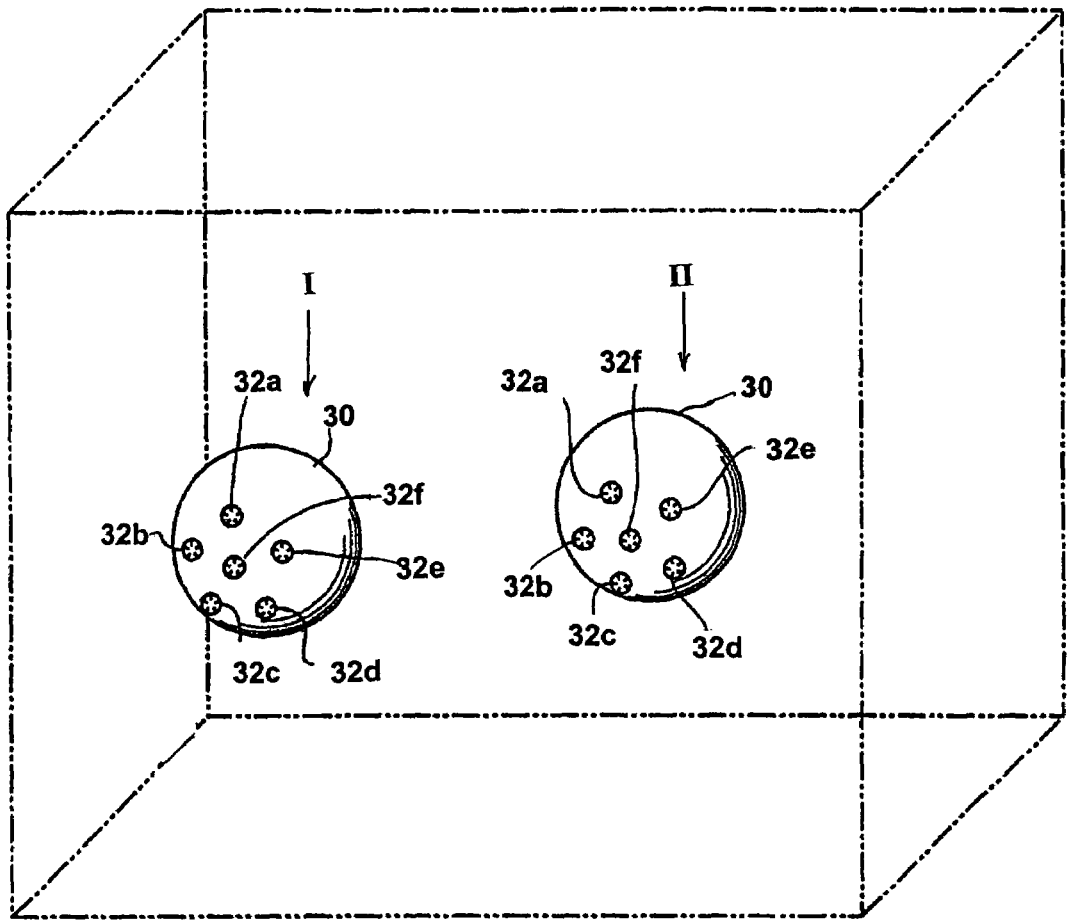
FIG. 4 is a perspective view of a three dimensional rectilinear field showing a golf ball at two different positions I and II.

As shown in FIG. 2, this particular calibration apparatus 20 has four golf balls 30 equally spaced and distanced from the center of the wheel 26. The apparatus incorporates four evenly spaced golf balls 30 on a known radius from the center of the wheel 26. Each golf ball 30 has six specific contrasting markings such as dots, bars or stripes 32, one in the center of the ball and the other five evenly distributed about the center. As shown in a three-dimensional, predetermined, rectilinear field of view (shown in phantom) in FIG. 4, a golf ball 30 preferably having six (6) round areas or dots 32 *a-f* placed thereupon. As the wheel 26 is set into motion and the predetermined rotation is established, then the cameras 136, 138 of the monitor are triggered by a proximity laser, and camera images produced capture specific contrasting areas or markings on the balls 30. These images, after being analyzed by the computer, are formulated and presented as speed, velocity and spin rate units. In FIG. 4, golf ball 30 is shown in two positions I and II to correspond to the locations of the golf ball 30 when imaged by the launch monitor 100. The image taken at position I occurs at a first time and occurs at a second time at position II. The preferred diameters of the round dots 32 *a-f* range from one-tenth (1/10) to one-eighth (1/8) of an inch, but other sizes and shaped areas can be used. Dots 32 *a-f* may be non-reflective, appearing as dark areas on the silicon panel, or they may be made of a reflective material that is adhered to the golf ball. Alternatively, painted markings can be used that define contrasting areas. At least one marking or contrasting area is used for the golf ball. Preferably, the number of markings or areas is as few as three (3) and up to six (6). Both cameras 136, 138 are positioned such that light will be reflected and received at both positions shown in FIG. 4. Successive images I and II show the rotation and distance of golf ball travel, and since the time between images is known, then the speed and velocity is easily calculated. The data obtained by the monitor 100 is compared to the established and fixed data of the calibration apparatus whereby any variations by the monitor 100 can be corrected.

The preferred distance between the center of the wheel 26 and the center of the ball 30 is between six (6) and twelve (12)

inches and the preferred range for wheel revolution rate is between 1,000 to 6,000 rpm. The following table illustrates the resultant ball velocity for several alternative distances and revolution rates.

| Revolution Rate (rpm) | Distance from Wheel Center to Ball Center (inches) | Ball Velocity (mph) |
|---|---|---|
| 2000 | 6 | 71.4 |
| 3500 | 6 | 124.9 |
| 5000 | 6 | 178.5 |
| 1500 | 9 | 80.3 |
| 2500 | 9 | 133.9 |
| 3000 | 9 | 160.6 |
| 1500 | 12 | 107.1 |
| 2500 | 12 | 178.5 |

While the above invention has been described with reference to certain preferred embodiments, it should be kept in mind that the scope of the present invention is not limited to these embodiments. The embodiments above can also be modified so that some features of one embodiment are used with the features of another embodiment. One skilled in the art may find variations of these preferred embodiments which, nevertheless, fall within the spirit of the present invention, whose scope is defined by the claims set forth below.

What is claimed is:

1. A calibration apparatus for calibrating a golf ball launch monitor, the apparatus comprising:

a support structure;

a wheel having at least one golf ball embedded at a predetermined distance from the center of the wheel;

means disposed on the support structure for rotating the wheel at predetermined rotation rates to establish a known speed and spin rate of the golf ball;

a cover surrounding the wheel with a field-of-view opening defined in a lower portion of the cover; and a means to trigger at least one camera of the launch monitor for capturing at least two images of the golf ball in the field-of-view.

2. The calibration apparatus of claim 1, wherein four golf balls are embedded in four equidistant locations from the center of the wheel.

3. The calibration apparatus of claim 1, wherein the predetermined distance is between about 6 and about 12 inches.

4. The calibration apparatus of claim 1, wherein the predetermine rotation rates of the wheel are between 1000 and 6000 rpm.

5. A method of calibrating a golf ball launch monitor, comprising the steps of:

providing the launch monitor that comprises at least one camera for capturing golf ball images;

providing a calibration apparatus having a rotatable circular wheel, the wheel having at least one golf ball embedded therein with at least one contrasting marking, the golf ball placed at a predetermined distance from a center of the wheel, a wheel cover having a field-of-view opening defined in a lower portion of the cover;

measuring a distance between the launch monitor and the at least one golf ball embedded in the wheel;

focusing the at least one camera upon the field-of-view;

rotating the wheel at a predetermined revolution rate wherein the at least one golf ball is visible through the field-of-view opening defined in the cover and a speed and a spin rate of the at least one golf ball are known constants;

capturing at least two images of the at least one golf ball and calculating units of ball speed and ball spin rate; and comparing the ball speed and ball spin rate data obtained by the launch monitor against the known speed and spin rate of the calibration apparatus, wherein the accuracy of the launch monitor is verified or amended.

6. The method of claim 5, wherein the calibration apparatus comprises a plurality of golf balls embedded and evenly spaced in the wheel at locations measured from the center of the wheel.

7. The method of claim 5, wherein the predetermined distance is between about 6 to about 12 inches.

8. The method of claim 5, wherein the predetermined revolution rate is between 1000 and 6000 rpm.

* * * * *